US012378835B2

(12) United States Patent
Wang et al.

(10) Patent No.: US 12,378,835 B2
(45) Date of Patent: Aug. 5, 2025

(54) METHOD AND DEVICE FOR DOWNHOLE TREATING GAS WELLS

(71) Applicant: Saudi Arabian Oil Company, Dhahran (SA)

(72) Inventors: Qiwei Wang, Dhahran (SA); Jairo Leal Jauregui, Udhailiyah (SA); Mauricio Armando Espinosa Galvis, Abqaiq (SA); Tao Chen, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/456,859

(22) Filed: Aug. 28, 2023

(65) Prior Publication Data

US 2025/0075577 A1 Mar. 6, 2025

(51) Int. Cl.
*E21B 27/02* (2006.01)

(52) U.S. Cl.
CPC ..... *E21B 27/02* (2013.01)

(58) Field of Classification Search
CPC ..... E21B 27/02
See application file for complete search history.

(56) References Cited

U.S. PATENT DOCUMENTS 2,760,584 A 8/1956 Rohrback
4,291,763 A 9/1981 Singer
4,713,184 A 12/1987 Zaid
4,923,617 A 5/1990 Heilweil et al.
5,294,371 A 3/1994 Clubley et al.
5,330,004 A 7/1994 Williams et al.
5,403,493 A 4/1995 Mouche
6,478,089 B2 11/2002 Alves et al.
6,655,475 B1 12/2003 Wald
7,196,040 B2 3/2007 Heath et al.
7,419,937 B2 9/2008 Rimmer et al.
7,556,100 B2 7/2009 Steiner
8,323,417 B2 12/2012 Fan et al.
9,447,657 B2 9/2016 Parker
9,890,623 B2 2/2018 Ghorbani et al.
10,280,714 B2 5/2019 Fouchard
10,421,893 B2 9/2019 Vo et al.
(Continued)

OTHER PUBLICATIONS

Al-Tammar et al., "Downhole Corrosion/Scaling Operational Experience and Challenges in HP/HT Gas Condensate Producers," Paper presented at the SPE International Oilfield Corrosion Conference and Exhibition, Aberdeen, Scotland, Paper No. SPE-169618, May 2014, 15 pages.

(Continued)

*Primary Examiner* — Dany E Akakpo
(74) *Attorney, Agent, or Firm* — Fish & Richardson P.C.

(57) ABSTRACT

A system and method are provided for adding chemicals to a produced fluid in a wellbore. An exemplary system includes a gauge hanger and a permeable container. The permeable container includes a solid cylindrical body, end caps placed at each end of the solid cylindrical body, and holes disposed proximate to each end of the permeable container, wherein the holes allow the produced fluid to flow through the permeable container from one end of the permeable container to the opposite end of the permeable container. The system further includes a well treatment chemical disposed in the permeable container.

22 Claims, 9 Drawing Sheets

(56) References Cited

U.S. PATENT DOCUMENTS

| | | | | |
|---|---|---|---|---|
| 10,717,918 | B2 | 7/2020 | Fouchard et al. | |
| 10,865,339 | B2 | 12/2020 | Dreyer et al. | |
| 11,015,069 | B2 | 5/2021 | Xia et al. | |
| 11,142,680 | B2 | 10/2021 | Dreyer et al. | |
| 2004/0084186 | A1 | 5/2004 | Allison | |
| 2007/0039739 | A1* | 2/2007 | Wilson | E21B 33/068 166/105 |
| 2009/0114247 | A1 | 5/2009 | Brown et al. | |
| 2011/0162841 | A1 | 7/2011 | Wilson | |
| 2011/0308625 | A1* | 12/2011 | Stoisits | F17D 1/14 137/1 |
| 2015/0233228 | A1 | 8/2015 | Roth | |
| 2018/0340114 | A1 | 11/2018 | Fouchard et al. | |
| 2020/0340334 | A1* | 10/2020 | Jarratt | E21B 43/25 |
| 2021/0010366 | A1 | 1/2021 | Chen et al. | |
| 2022/0397031 | A1* | 12/2022 | Gomes | E21B 27/02 |
| 2023/0167558 | A1 | 6/2023 | Chen et al. | |
| 2024/0141756 | A1 | 5/2024 | Wang et al. | |

OTHER PUBLICATIONS

Al-Thuwaini et al., "Encapsulated Scale Inhibitor Treatment," Paper SPE-37790-MS, presented at the SPE Middle East Oil Show, Bahrain, Mar. 1997, 5 pages.

Askari et al., "Downhole corrosion inhibitors for oil and gas production—a review," Applied Surface Science Advances, Dec. 2021, 6, 23 pages.

Asrar et al., "Corrosion—The Longest War," Oilfield Reviews, May 2016, 28(2):16 pages.

Bentiss, et al., "The Substituted 1,3,4-Oxadiazoles: A New Class of Corrosion In-hibitors of Mild Steel in Acidic Media," Corrosion Science, 2000, 42:127-146, 20 pages.

Bhaduri et al., "Application of Solid Scale Inhibitor in Annular Space to Reduce Well Intervention Cost," Paper SPE-189489-MS, 2018, 9 pages.

Bhaduri et al., "The Application of Solid Scale Inhibitor in Deep-water Completion to Reduce Well Intervention Costs," NACE-2018-10534, 2018, 14 pages.

Bourne et al., "Effective Treatment of Subsea Wells with a Solid Scale Inhibitor System," Paper SPE-60207-MS, Second International Symposium on Oilfield Scale held in Aberdeen, UK, Jan. 2000, 9 pages.

Chen et al., "Saudi Arabia's Master Gas System—Its Overview and the Corrosion Control Programs," SPE Annual Technical Conference and Exhibition, New Orleans, Louisiana, Paper No. SPE-11107-MS, Sep. 1982, 8 pages.

Duncan et al., "Foam Sticks Application to Increase Production and Encapsulated Inhibitors to Mitigate Corrosion & Scale Formation," Paper SPE-156213-MS, SPE/PAPG Annual Technical Conference held in Islambad, Pakistan, Nov. 2011, 10 pages.

Fingar et al., "Application of corrosion inhibitors for steels in acidic media for the oil and gas industry: A review," Corrosion Science, Sep. 2014, 86:17-41, 25 pages.

Hsu et al., "Encapsulated Scale Inhibitor Treatments experience in the Ghawar Field, Saudi Arabia," SPE-60209-MS, presented at the 2000 Second International Symposium on Oilfield Scale, Aberdeen, UK, Jan. 2000, 6 pages.

Jenkins, "The Challenges Associated with the Development and Application of Oil and Gas Corrosion Inhibitors," SPE-169615-MS, SPE International Oilfield Corrosion Conference and Exhibition held in Aberdeen, Scotland, UK, May 2014, 13 pages.

Kasnick, "Khuff Gas Production Experience," Paper presented at the Middle East Oil Show, Bahrain, Mar. 1987, Paper No. SPE-15764-MS, Mar. 1987, 8 pages.

Leal et al., "Successful Long Duration Batch Treatment of Gas Well to Prevent Corrosion Challenges and Solutions," Paper presented at the International Petroleum Technology Conference, Dhahran, Kingdom of Saudi Arabia, Jan. 2020, Paper No. IPTC-19640, Jan. 2020, 11 pages.

Leasure et al., "Effective Scale Prevention Using Chemically Infused Proppant—A Uinta Basin Case History," SPE-173792-MS, presented at the SPE International Symposium on Oilfield Chemistry, The Woodlands, Texas, USA, Apr. 2015, 13 pages.

Mainier et al., Evaluation of Titanium in Hydrochloric Acid Solutions Containing Corrosion Inhibitors, IOSR Journal of Mechanical and Civil Engineering, Dec. 2013, 10(1):66-69, 4 pages.

Powell et al., "Encapsulated Scale Inhibitor for Use in Fracturing Treatments," Paper SPE-30700-MS, presented at the SPE Annual Conference and Exhibition, Dallas, TX, USA, Oct. 1995, 7 pages.

Ruiz et al., "Application of Encapsulated Scale Inhibitors—Understanding the Field Success Factors," Paper NACE-2017-9527, 2017, 16 pages.

Schenkel et al., "Production Optimization: Understanding and Solving Scale Formation in Mature Gas Wells," SPE-201301-MS, presented at the SPE Annual Technical Conference & Exhibition, Denver, Colorado, USA, Oct. 2020, 13 pages.

Szymczak et al., "Minimizing Environmental and Economic Risks with a Proppant-Sized Solid Scale Inhibitor Additive in the Bakken Formation," SPE-159701-MS, Society of Petroleum Engineers, 2012, pages.

Turki, "Drilling and Production of Khuff Gas Wells, Saudi Arabia," Paper presented at the SPE/IADC Drilling Conference, Amsterdam, Netherlands, Paper No. SPE-21975-MS, Mar. 1991, 10 pages.

Watson et al., "Foam Sticks Application to Increase Production and Encapsulated Inhibitors to Mitigate Corrosion & Scale Formation," SPE-156213-MS, presented at the SPE/PAPG Annual Technical Conference, Islamabad, Pakistan, Nov. 2011, 10 pages.

Weghorn et al., "Enhancing Chemical Efficiency Using Slow-Release Corrosion Inhibitors," SPE-93169-MS, Spe International Symposium on Oilfield Chemistry in Houston, Texas, Feb. 2005, 5 pages.

Weghorn et al., "Field Evaluation of An Encapsulated Time-Release Corrosion Inhibitor," NACE-07321, 2007, 10 pages.

* cited by examiner

METHOD AND DEVICE FOR DOWNHOLE TREATING GAS WELLS

TECHNICAL FIELD

This disclosure relates to methods of continuously adding of downhole well treatment chemicals to produced fluids.

BACKGROUND

Downhole tubular degradation by corrosion attack is often a significant concern in natural gas production operations, especially for these producing from high-pressure, high water volume, high-temperature (HPHT) reservoirs, low pH, high chloride content as well as produced gas containing high levels of acidic gases. $CO_2$ and $H_2S$. Localized, or pitting, corrosion can degrade tubular integrity and the consequences of failure to manage can be costly.

Metallurgical solutions can be effective deterrents of corrosion, but their costs could be beyond the economic limit of many projects. In many cases, low alloy carbon steel is used. In these cases, inhibitor treatment is required to keep the corrosion rate under the acceptable limit. The use of corrosion inhibitors is often considered as the most cost-effective solution for corrosion control in gas production wells. Mild steel corrosion can be significantly reduced by the presence of corrosion inhibitor in small concentrations. Corrosion inhibitors are defined as chemicals that retard corrosion when added to a corrosive environment. Effective corrosion control varies with different fluid compositions, environmental conditions, production rates, and different flow regimes.

Corrosion inhibitors used can create a continuous layer between the metal and the reactive fluids, thus reducing the attack of corrosion elements. They also attach to the surface of corroded metal, altering it and reducing the corrosion rate. In general, they are organic compounds that contain unsaturated bonds and heteroatoms, such as N, O, S, and the like. The corrosion inhibitors can form coordination bonds with empty orbits of metal elements, adsorbing on the metal surface to protect metal material. The most commonly used corrosion inhibitors in downhole tubulars include long chain primary amines, imidazolines, fatty acids, and phosphate esters. Further, a single compound is often insufficient to protect carbon steel because of the different corrosion mechanism associated to $CO_2$, $H_2S$ presence but also if increased water production changes on chloride contents creating more severe corrosive environments. Complex formulations containing a wide range of compounds are often used. The development of inhibitor mixtures having a synergistic inhibition effect is the economical and effective way for increasing the inhibition efficiency. Synergistic inhibitors decrease the amount of usage and diversify the application of inhibitors in aggressive medium.

SUMMARY

An embodiment described herein provides a method of adding chemicals to downhole produced fluids in a wellbore. The method includes placing a well treatment chemical in a permeable container. The permeable container includes a solid cylindrical body, caps placed at each end of the solid cylindrical body, and holes disposed proximate to each end of the permeable container. The permeable container is hung in a flow of the produced fluids, wherein the holes allow the produced fluid to flow through the permeable container from one end of the permeable container to an opposite end of the permeable container.

Another embodiment described herein provides a system for adding chemicals to a produced fluid in a wellbore. The system includes a gauge hanger and a permeable container. The permeable container includes a solid cylindrical body, end caps placed at each end of the solid cylindrical body, and holes disposed proximate to each end of the permeable container, wherein the holes allow the produced fluid to flow through the permeable container from one end of the permeable container to the opposite end of the permeable container. The system further includes a well treatment chemical disposed in the permeable container.

DETAILED DESCRIPTION

Figure 1:
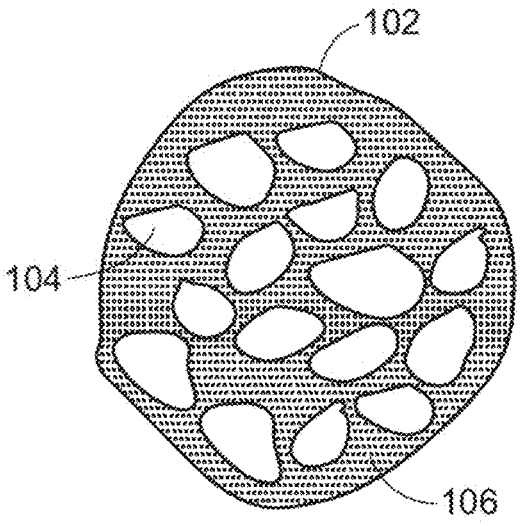
FIG. 1 is a drawing of an encapsulated corrosion inhibitor particle.

Embodiments described herein provide a system and method for continuously add well treatment chemicals, such as corrosion inhibitors, encapsulated scale inhibitors, low release foamed agents, sour service scavenger among others, to production fluids in a wellbore. In an embodiment, the system includes a permeable container. The permeable container has holes formed proximate to the top and the bottom to allow the production fluids to flow through the permeable container to add the well treatment chemicals to the production fluids. The holes in the permeable container may be covered by a mesh or wire screen to allow larger holes to be used with smaller particles. The rate of the addition can be controlled by the size, placement, surface riser deployment capacity and number of holes in the permeable container. Further, the rate of addition can also be controlled by the type of well treatment chemical used, downhole temperatures and well drawdown, for example, an encapsulated corrosion inhibitor.

For effective corrosion inhibition, the surface of a tubular to be protected must be fully covered by the corrosion inhibitor molecules. Interactions with the produced fluids gradually remove inhibitor molecules and they must be replenished with the new inhibitor. Thus, the presence of proper concentrations of inhibitor in the produced fluid is critical to the successful treatment. The proper application in the field is of equal importance. In gas wells, there are two types of inhibitor applications, continuous injection, and batch treatment.

Continuous injection is normally done through a capillary tubing to supply a continuous residual of inhibitor with sufficient concentration to maintain acceptable protection. The disadvantages of this application include high maintenance cost and failure of the injection system. Metering pumps require power and extensive maintenance. Further, the operational cost can be high for some applications, such as remote areas. The solvent in the injected inhibitor product can also be flashed off by produced gas and cause a "gunking" or gelling problem. The gunking problem can plug the injection nozzle, stopping the flow of the inhibitor. This is especially problematic for deep gas wells producing from high temperature reservoirs.

Batch treatment is a more common method of inhibitor application. In a batch treatment, an inhibitor solution is injected into a shut-in well and allowed to flow to the bottom to coat the surface of the tubular with the inhibitor film. The duration of the shut-in time as well as chemical percolation factors are critical factors and for successful batch treatment and is usually several hours. However, in mature gas wells, depleted reservoir pressure may allow the corrosion inhibitor to enter the reservoir near the wellbore. This can result in the inhibitor changing the reservoir rock wettability, which can end-up cause well formation damage, change on near wellbore saturation wettability and else potential for loss of well productivity. Further, the inhibitor film is often stripped off by produced gas, especially at the upper portion of tubular, where pressure is reduced, density change, flow segregate and gas flow rate are high. In these cases, frequent treatment will be required.

Figure 2:
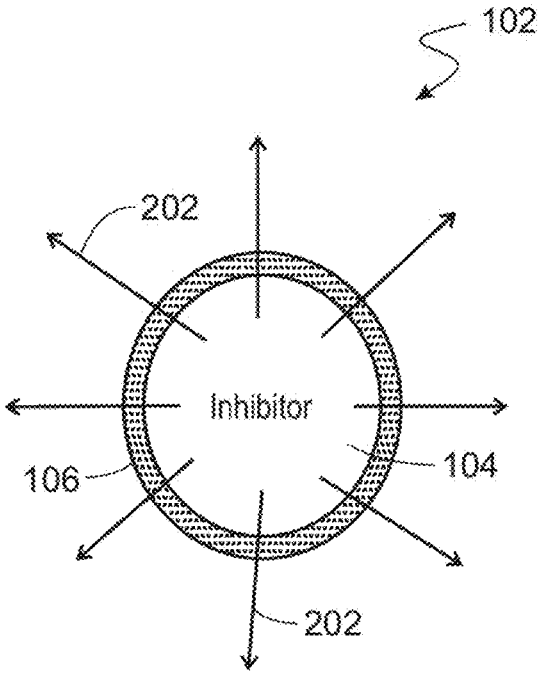
FIG. 2 is a drawing of the diffusion from the encapsulated corrosion inhibitor as well as diluting mechanism.

FIG. 1 is a drawing of an encapsulated corrosion inhibitor 102. In addition to the addition techniques described above, encapsulated corrosion inhibitors 102 have also been used in oilfields. In the encapsulated corrosion inhibitors 102, a corrosion inhibitor 104 is encapsulated in a permeable polymer material 106. FIG. 2 is a drawing of the diffusion 202 from the encapsulated corrosion inhibitor 102. In this embodiment, the permeable polymer material 106 is a polymer membrane surrounding the corrosion inhibitor 104, which is in a core of the encapsulated corrosion inhibitor 102. The particles of the encapsulated corrosion inhibitor 102 are placed at the bottom of wellbores, either by free fall or using coiled tubing, where they are allowed to settle and develop an inhibitor concentration gradient. This method is limited to vertical, wells that have a rathole, or nonproductive extension of the well past the production zone.

The corrosion inhibitors include organic compounds that contain unsaturated bonds and heteroatoms, such as N, O, and S. The corrosion inhibitors can include imidazoline, imidazole, quinoline, pyridine, and their derivatives, primary, secondary, tertiary, and quaternary amines, n-dodecylamine, N—N-dimethyl dodecylamine, amide, amidoamine, amidoimidazoline, isoxazolidine, succinic acid, carboxylic acid, aldehyde, alkanolamine, imidazoline-imidazolidine compound, α, β-ethylene unsaturated aldehyde, polyalkylenepolyamine, diethylenetriamine, or mixtures of these compounds.

For dry gas wells producing small amounts of water, this application method is not suitable due to limited interactions between the produced fluid and solid inhibitor particles.

Figure 3:
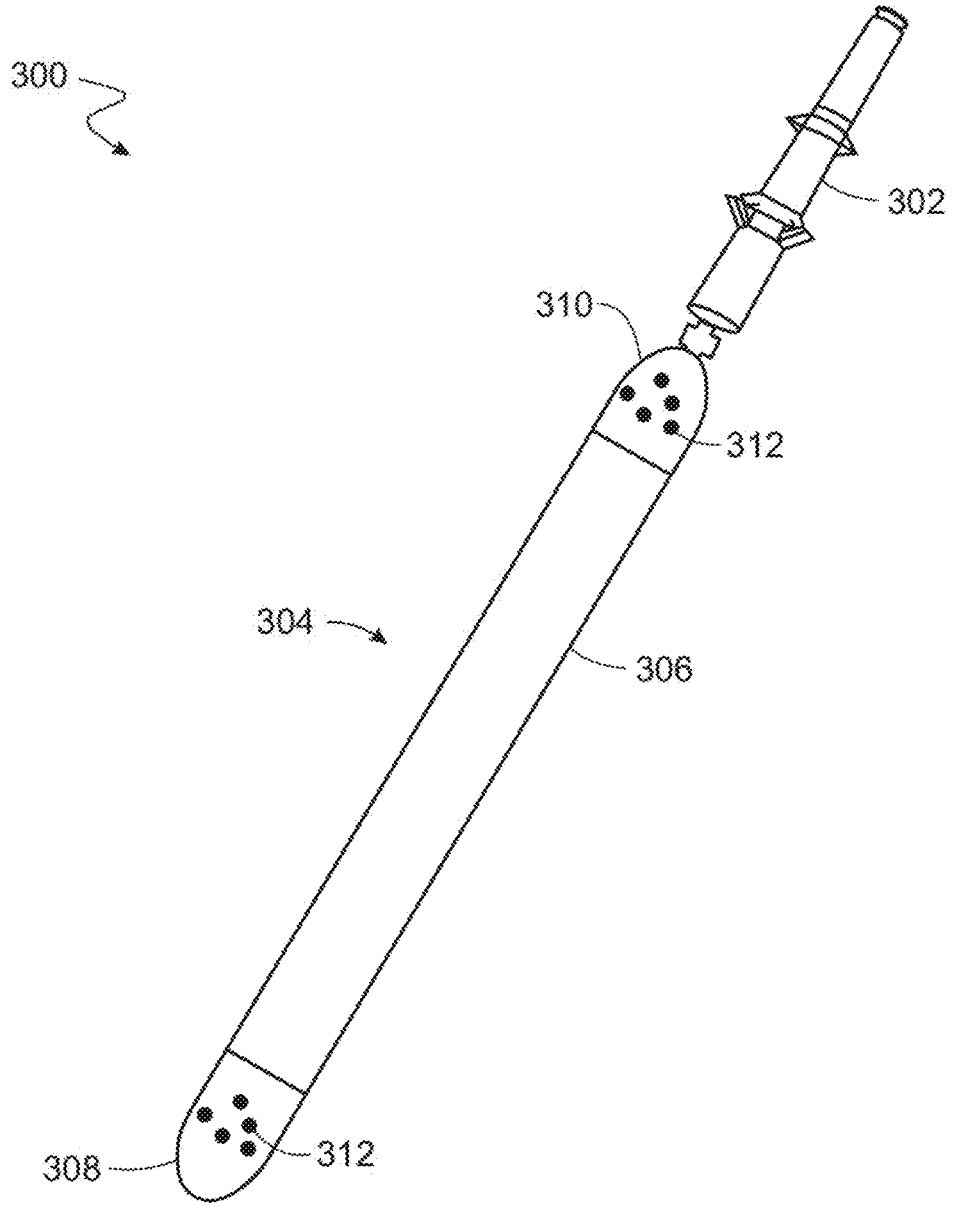
FIG. 3 is a drawing of a downhole device for continuously adding well treatment chemicals to a production fluid in a wellbore.

FIG. 3 is a drawing of a device 300 for continuously adding well treatment chemicals to a production fluid in a wellbore. The device 300 includes two body segments, a hanger 302 and a permeable container 304. The permeable container 304 has a solid cylindrical body 306 and caps 308 and 310 placed at each end of the solid cylindrical body 306. The caps 308 and 310 may be flat or, as shown in FIG. 3, hemispherical. The permeable container 304 and the caps 308 and 310 are made of stainless steel or corrosion resistant alloy (CRA) metallurgy, depending on the well conditions and the concentration of acidic gases.

Holes 312 in the caps, or both the cap and body are formed at each end of the permeable container. The permeable container 304 is suspended from the hangar 302, for example, a gauge hanger, in the flow of the produced fluids. The holes 312 allow the produced fluid to flow through the permeable container from one end of the permeable container to an opposite end of the permeable container, for example, from a cap 308 at a lower end of the permeable container 304 to the cap 310 at the upper end of the permeable container 304.

The device 300 can be used with any number of well treatment chemicals, including encapsulated corrosion inhibitors for protecting downhole tubular in gas wells, among others. The encapsulated corrosion inhibitor, or other well treatment chemical, is placed in the permeable container 304. The well treatment chemical is placed in the permeable container 304 prior to the device 300 being placed in the wellbore.

The permeable container 304 is connected to a hanger 302 which can be installed at a pre-determined depth in a wellbore, such as a gas well, using slickline deployment, digital slickline, E-line, braided line, or coiled tubing. The placement depth can be determined by historical well log data or based on well deviation, drift run results and previous well model predictions. As the produced fluids flow through the permeable container 304, the well treatment chemical is released into the produced fluids. The concentration of the well treatment chemicals in the produced fluid can be monitored from residual samples taken at the wellhead. Once the concentration falls below a targeted level Minimum Inhibitor Concentration (MIC)), the device 300 can be retrieved. The permeable container 304 is then refilled with a new amount of the well treatment chemical. For a corrosion inhibitor, the volume of the corrosion inhibitor material, as well as release mechanism, can be adjusted based upon recorded downhole temperature, water production, downhole drawdown, pipe metallurgy, $H_2S/CO_2$ ratios, production chemistry parameters and fluid concentrations.

In various embodiments, the permeable container 304 is made of low alloy carbon steels, stainless steel, or corrosion resistant alloy (CRA) metallurgy, depending on sour service scenario and particular well conditions. The number of holes 312, as well as the size and density of the holes, in the caps 308 and 310 and the sides of the permeable container 304 can be adjusted based on the fluid production rate and required concentration of the well treatment chemical to maximize the treatment efficiency and extend treatment life. In some embodiments, the holes 312 may be covered by a mesh screen, such as a wire screen, to allow larger holes to be used with smaller particles.

Figure 4:
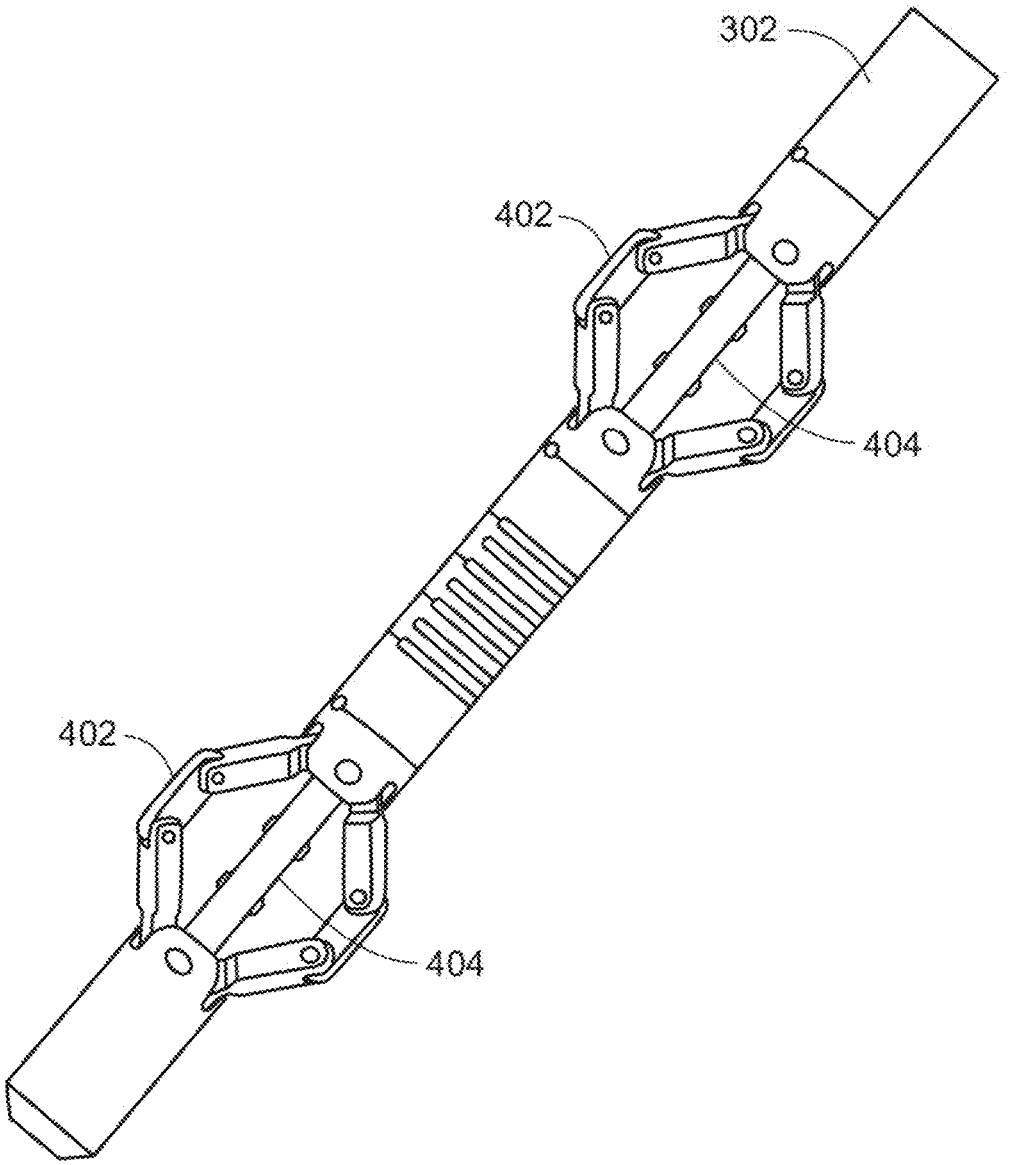
FIG. 4 is a drawing of a downhole hanger/fishing neck (upper body segment) that can be used in suspending the permeable container.

FIG. 4 is a drawing of a hanger 302 that can be used in suspending the permeable container 304. Like numbered items are as described with respect to FIG. 3. The hanger 302 is a fishing neck/gauge hanger that has axial protrusions 402 that are extended or retracted, for example, as a shaft 404 passing through the center axis of the hangar 302 is rotated. When extended, the axial protrusions 402 contact the side of the tubular, holding the hangar 302 and the suspended permeable container 304 in place in the wellbore. The hanger 302, with the attached permeable container 304, is set and retrieved using conventional slickline or coiled tubing methods. This allows the permeable container 304 to be mounted at any selected depth in a vertical section of a well tubular.

Figure 5:
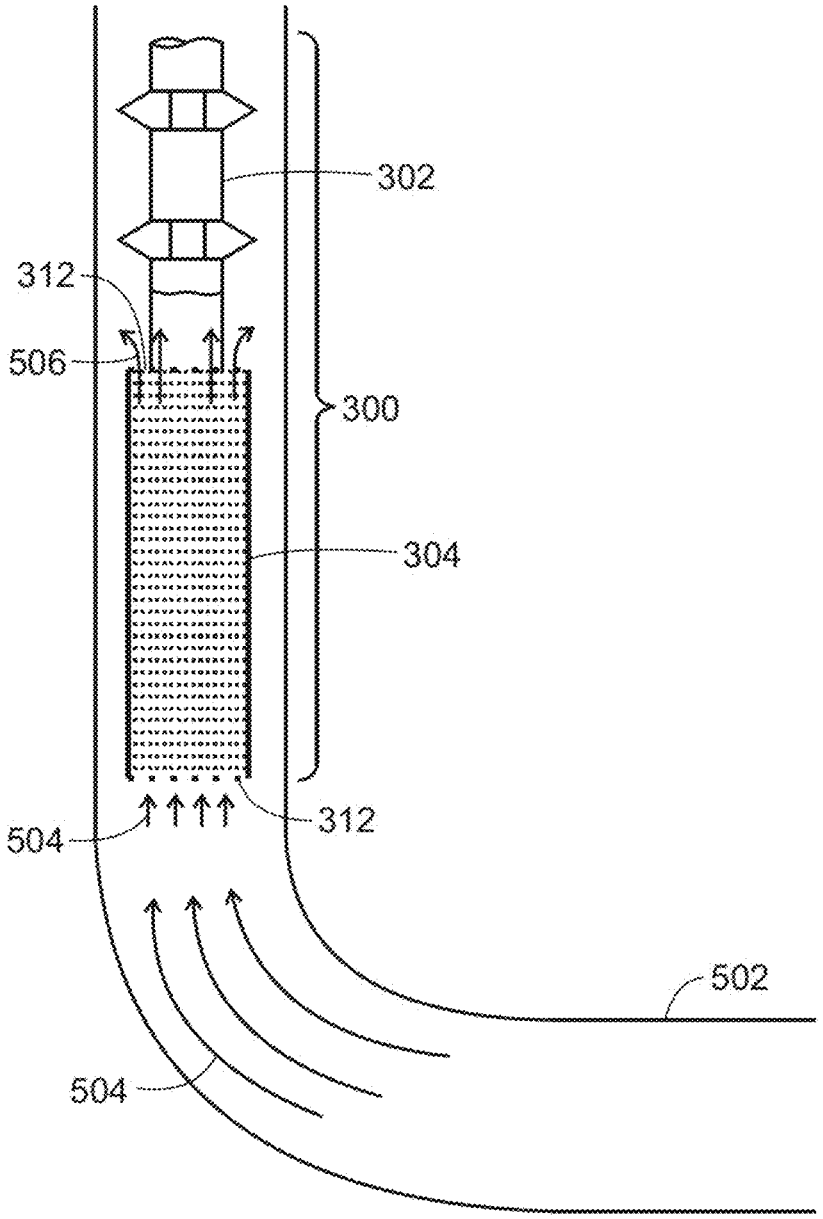
FIG. 5 is a schematic drawing of the downhole device (both upper and lower sections), being installed in a vertical section of a well tubular.

FIG. 5 is a schematic drawing of the device 300 installed in a vertical section of a tubular 502. As described with respect to FIG. 4, the hangar 302 holds the permeable container 304 at a predetermined depth. In various embodiments, the placement depth is determined by historical well log data, well accessibility report, gauge cutter results as described further with respect to FIGS. 6A and 6B. In some embodiments, the placement depth is determined by predictions of the corrosion and based on models.

In operation, a portion of the produced fluids 504 in the tubular 502 enter the permeable container 304 through the holes 312 at the bottom of the permeable container 304. A portion of the well treatment chemical in the permeable container 304 then leaches or dissolves into the produced fluids 504, and the treated produced fluids 506 exit the permeable container 304 through the holes 312 at the top of the permeable container 304.

The concentration of the well treatment chemicals, such as the corrosion inhibitor, in the produced fluid 504 and 506 can be monitored from samples (residuals) collected and monitored at the wellhead. When the concentration is less than the minimum target dosage (minimum inhibitor concentration), the device 300 is latch and retrieved to the surface. In some embodiments, the permeable container 304 is refilled with well treatment chemicals and deployed repeatedly. The well treatment chemicals may be the same as initially used or may be varied as function of surface riser extension, treatment volume design and specific well by well requirement on well integrity monitoring, corrosion protection and other purposes.

Figure 6A:
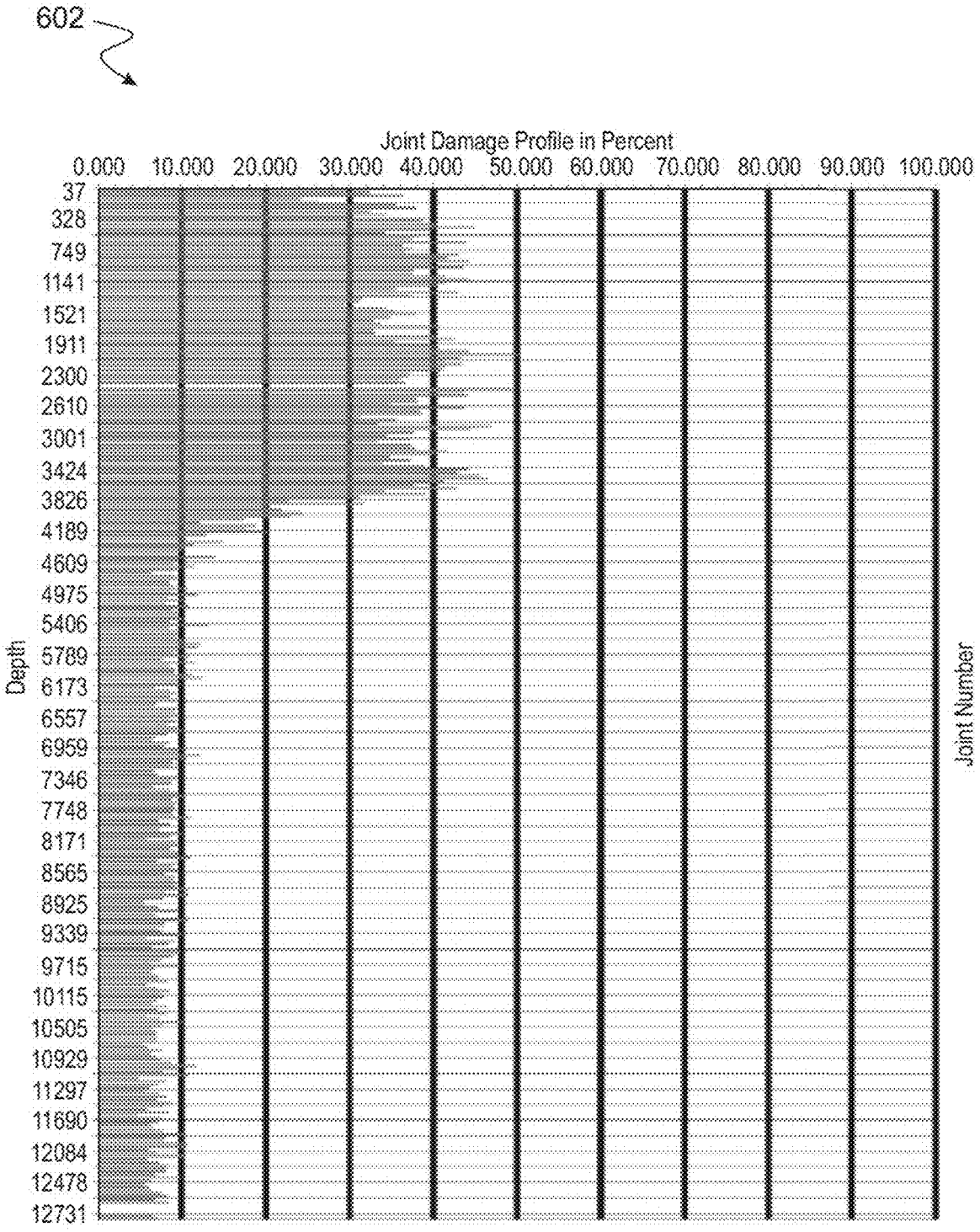
FIGS. 6A and 6B are plots of multi-finger imaging tool (MIT) caliper logs of downhole tubulars in two sets sweet gas wells showing the metal losses due to generalized $CO_2$ corrosion (as an example).
Figure 6B:
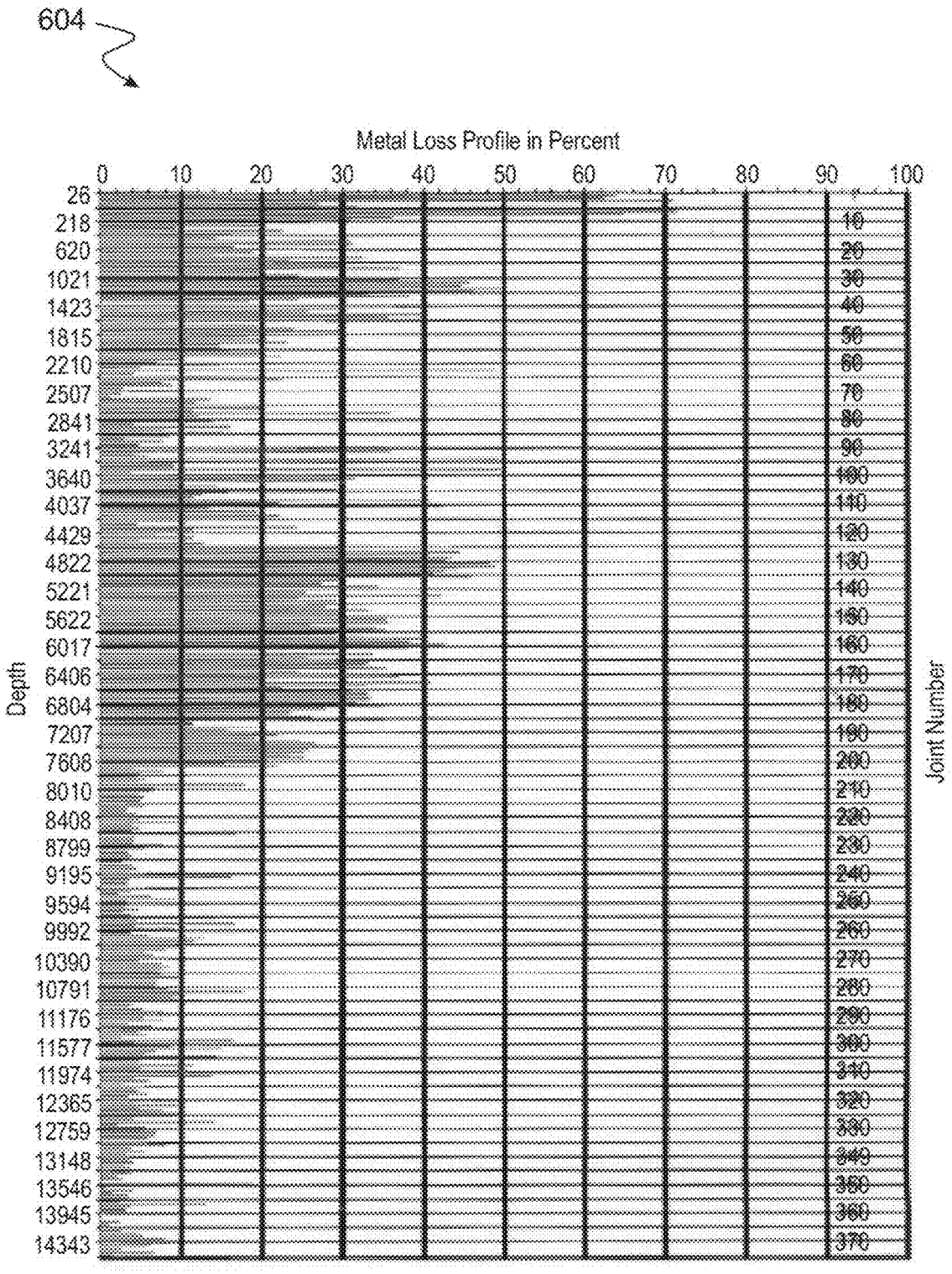

FIGS. 6A and 6B are plots of multi-finger imaging tool (MIT) caliper logs of downhole tubulars in two sweet gas wells showing the metal losses due to $CO_2$ corrosion. The MIT is a mechanical device with an array of hard surfaced fingers. Each finger contacts an inside wall of a tubular measuring radius with precise resolution and accuracy. The MIT is able to detect very small changes of the internal surface conditions (360 deg direction) and with a high degree of accuracy.

The plot of FIG. 6A shows that the corrosion rate in the first well accelerated at a depth 602 of about 4500 ft (about 1,370 m). Thus, the device 300 (FIG. 3) should be mounted at a depth below about 4,500 ft. The plot of FIG. 6B shows that the corrosion rate and the second well accelerated at a depth 604 of about 8,000 ft. Thus, the device 300 should be deployed at least below 8,000 ft. inside production tubular and for the second well.

Figure 7A:
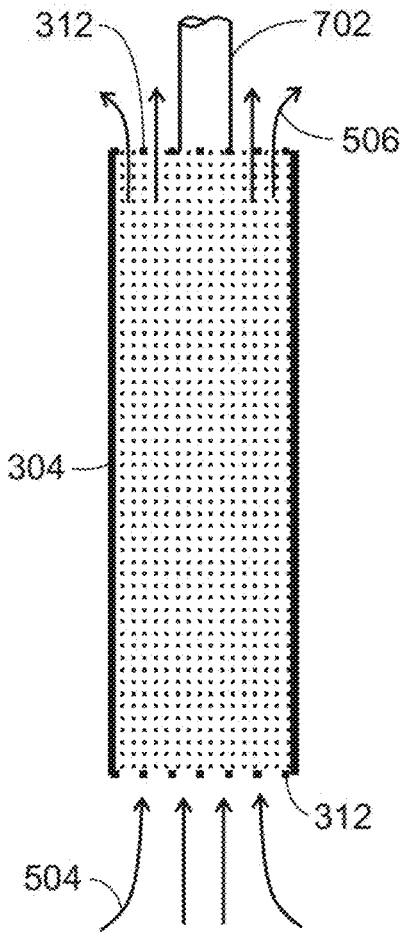
FIGS. 7A and 7B are schematic drawings of the permeable container describing flow paths and positions for the holes.
Figure 7B:
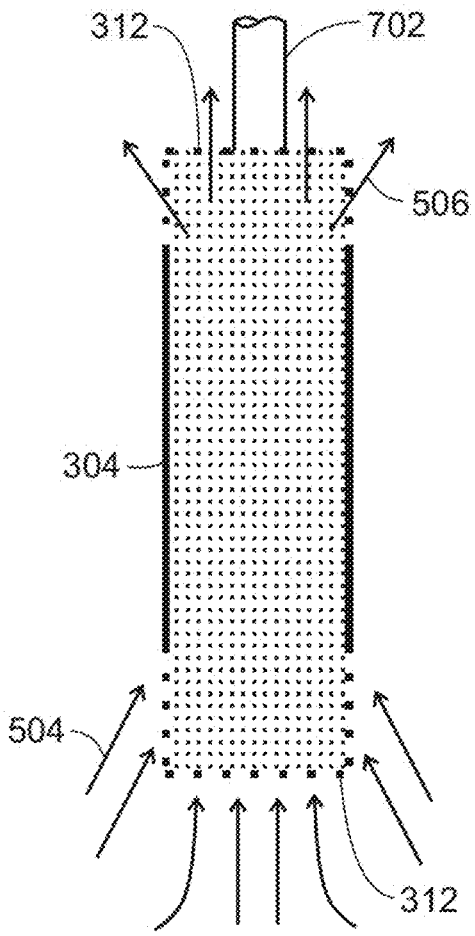

FIGS. 7A and 7B are schematic drawings of the permeable container 304 describing positions for the holes 312 (FIG. 3). As described herein the permeable container 304 holds the well treatment chemical, such as an encapsulated corrosion inhibitor, among others. The permeable container 304 is suspended from the hangar by a rod or cable 702. As shown in FIG. 7A, the permeable container 304 has holes 312 at each of the ends to allow produced fluid 504 to flow through, resulting in a treated produced fluid 506. For example, the encapsulated inhibitor molecules diffuse through the membrane into the produced fluids.

As shown in FIG. 7B, the sides of the permeable container 304 can also have openings disposed proximate to the ends to increase the amount of produced fluid, such as water, in contact with the well treatment chemical. This can be used to increase the inhibitor concentration in the produced fluids. The numbers of holes 312 can be varied based on the fluid production rate and required concentration.

Figure 8:
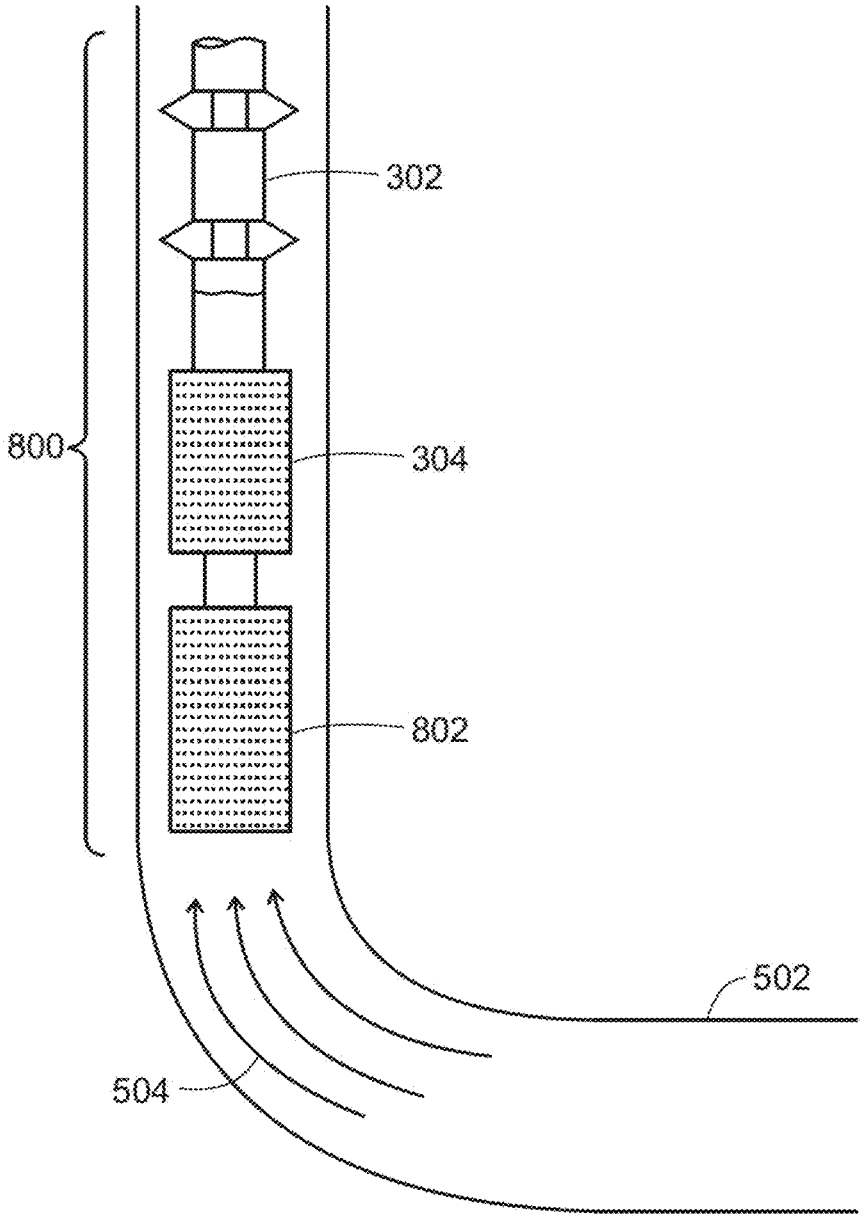
FIG. 8 is a schematic drawing of a device with two permeable containers.

FIG. 8 is a schematic drawing of a device 800 with two permeable containers 304 and 802. Like numbered items are as described with respect to FIGS. 3 and 5. The second permeable container 802 is hung from the permeable container 304. As described herein, the concentration of well treatment chemical, such as corrosion inhibitor, can be controlled by the use of high temperature (HT) encapsulation or free solid chemical. Encapsulated chemical can be distributed in different device baffles and concentrations as well. For example, an encapsulated corrosion inhibitor can be placed in the permeable container 304 for longer-term release of a corrosion inhibitor, while an unencapsulated corrosion inhibitor can be placed in the second permeable container 802 giving more flexibility on treatment design and long-term exposure. The number of holes in each of the permeable containers 304 and 802 can be adjusted based on the contents. For example, larger holes can be used with the encapsulated corrosion inhibitor, while smaller or fewer holes can be used in the permeable container holding the unencapsulated corrosion inhibitor.

Further, as described herein, the devices 300 and 800 are applicable for other production chemistry problems, such as inhibiting scale deposition or the formation or mitigation gas hydrates in downstream piping and equipment. This may be performed by placing the appropriate chemical products into the inhibitor chamber and container. In cases where different well treatment chemicals are used, a first chemical or chemical type may be placed in the permeable container 304, while a second chemical or chemical type may be placed in the second permeable container 802.

Figure 9:
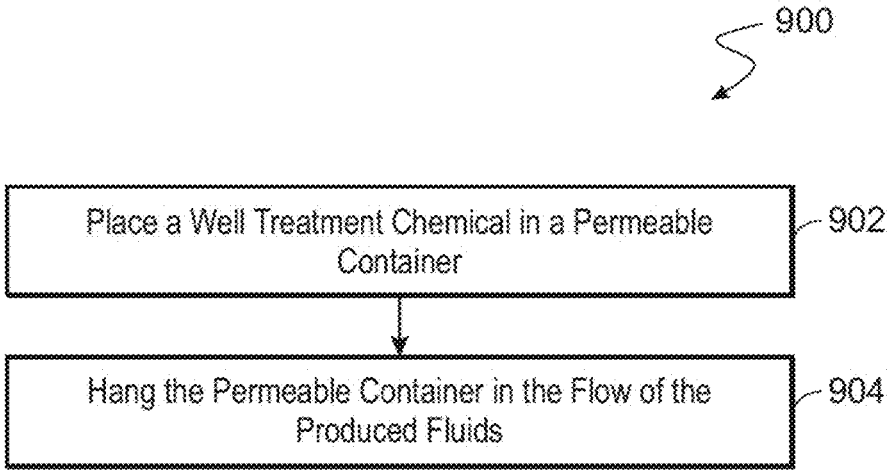
FIG. 9 is a block diagram of a method treating a tubular in a wellbore.

FIG. 9 is a block diagram of a method 900 treating a tubular in a wellbore. The method begins at block 902, when a well treatment chemical is placed in the permeable container. At block 904 the permeable container is hung in the flow of the produced fluids. In various embodiments, this is performed using surface riser, pressure control equipment and downhole well servicing tools, such as conventional slickline, digital slickline, E-line, braided line, or coiled tubing (CT). For example, to place the device 300 or 800, a run in-hole procedure (RIH) is used. The RIH procedure includes, as needed, an equipment rig up and pressure testing of the wellhead and equipment and pressure control equipment (PCE).

The accessibility of the well is confirmed, and the SL drift is tested. The device 300 or 800 is prepared for RIH, and the depth for placement is determined. The pull out of hole (POOH) drift is set based upon maximum tool Maximum Outside Diameter (OD).

The RIH is set, and the memory tool is activated to set the hanger at the correct depth, for example, using DPU-Programmable or Eline. The RIH is performed, and tool release is confirmed. Gently Tag. The tool is depth correlated, activated for setting and remaining part is pulled out of the hole (POOH) and the equipment is rigged down.

Once the concentration of the well treatment chemical or chemicals falls below a minimum target level, the device 300 or 800 is pulled from the wellbore for refill. This is performed following the opposite procedure from above. The POOH begins with the rigging of the equipment and a pressure test of the wellhead and PCE. The appropriate tool (fishing neck) is selected and identified and for specific hanger (based upon proper tool size) and prepared.

A downhole device, which includes two body segments, is designed to treat gas wells for dispensing chemicals in the flow of production fluids, for example, the protect a tubular from corrosion attack in both $H_2S$ and $CO_2$ scenarios. The upper body segment is a hanger that allows the devices to be securely anchored at a given depth and retrieved using conventional slickline, E-line, braided line, or coiled tubing methods. The lower body segment is a permeable container such as a tube with holes in the ends to allow produced fluids to flow through the permeable mesh container. Well treatment chemicals, such as corrosion inhibitors, diffuse into the produced fluid, and are carried into the tubular. The numbers of openings on tube ends and sides can be varied based on the fluid production rate and target dosage. The concentration of the well treatment chemical is monitored over time from samples collected at wellhead. Once the concentration is below the target minimum level, the device is retrieved to the surface, the container is refilled, and the device is redeployed.

Embodiment

An embodiment described herein provides a method of adding chemicals to downhole produced fluids in a wellbore. The method includes placing a well treatment chemical in a permeable container. The permeable container includes a solid cylindrical body, caps placed at each end of the solid cylindrical body, and holes disposed proximate to each end of the permeable container. The permeable container is hung in a flow of the produced fluids, wherein the holes allow the produced fluid to flow through the permeable container from one end of the permeable container to an opposite end of the permeable container.

In an aspect, combinable with any other aspect, the method includes placing the well treatment chemical in the permeable container comprises filling the permeable container with an encapsulated corrosion inhibitor.

In an aspect, combinable with any other aspect, the method includes selecting a size of the holes disposed proximate to each end of the permeable container based, at least in part, on a target addition rate of the well treatment chemical.

In an aspect, combinable with any other aspect, the method includes selecting a location of the holes at each end of the permeable container based, at least in part, on a target addition rate of the well treatment chemical.

In an aspect, combinable with any other aspect, the method includes selecting a location of the holes at each end of the permeable container based, at least in part, on a flow rate of the produced fluids.

In an aspect, combinable with any other aspect, the method includes selecting a number of the holes disposed proximate to each end of the permeable container based, at least in part, on a target addition rate of the well treatment chemical.

In an aspect, combinable with any other aspect, the method includes selecting a size of the holes, a number of the holes, or both, based, at least in part, on a concentration of hydrogen sulfide in the produced fluids.

In an aspect, combinable with any other aspect, the method includes selecting a size of the holes, a number the holes, or both, based, at least in part, on a concentration of carbon dioxide in the produced fluids.

In an aspect, combinable with any other aspect, the method includes suspending the permeable container in the wellbore using a gauge hanger.

In an aspect, combinable with any other aspect, the method includes suspending a second permeable container in the wellbore.

In an aspect, combinable with any other aspect, the method includes selecting a distance between the permeable container and the second permeable container based, at least in part, on the well treatment chemicals used in each container.

In an aspect, combinable with any other aspect, the method includes placing a first type of chemical in the permeable container and placing a second type of chemical in the second permeable container.

In an aspect, combinable with any other aspect, the method includes placing an encapsulated corrosion inhibitor in the permeable container and placing an unencapsulated corrosion inhibitor in the second permeable container.

In an aspect, combinable with any other aspect, the method includes placing an encapsulated corrosion inhibitor in the permeable container and placing a kinetic hydrate inhibitor in the second permeable container.

Another embodiment described herein provides a system for adding chemicals to a produced fluid in a wellbore. The system includes a gauge hanger and a permeable container. The permeable container includes a solid cylindrical body, end caps placed at each end of the solid cylindrical body, and holes disposed proximate to each end of the permeable container, wherein the holes allow the produced fluid to flow through the permeable container from one end of the permeable container to the opposite end of the permeable container. The system further includes a well treatment chemical disposed in the permeable container.

In an aspect, combinable with any other aspect, the permeable container comprises holes in the end caps, and wherein the holes are sized based, at least in part, on a flow rate of the produced fluid.

In an aspect, combinable with any other aspect, the permeable container comprises holes in the solid cylindrical body proximate to the cap at each end of the solid cylindrical body.

In an aspect, combinable with any other aspect, a mesh screen is disposed over the holes.

In an aspect, combinable with any other aspect, the well treatment chemical comprises particles of an encapsulated corrosion inhibitor disposed in the permeable container.

In an aspect, combinable with any other aspect, the well treatment chemical comprises a kinetic hydrate inhibitor disposed in the permeable container.

In an aspect, combinable with any other aspect, the system includes a second permeable container suspended from the permeable container by a cable. In an aspect, a length of the cable is selected based, at least in part, on a well treatment chemical disposed in the permeable container and a second well treatment chemical disposed in the second permeable container.

In an aspect, a second well treatment chemical disposed in the second permeable container includes a corrosion inhibitor.

In an aspect, a second well treatment chemical disposed in the second permeable container includes a kinetic hydrate inhibitor.

Other implementations are also within the scope of the following claims.

What is claimed is:

1. A method of adding chemicals to produced fluids in a wellbore, comprising:

placing a well treatment chemical in a permeable container, wherein the permeable container comprises:

a solid cylindrical body;

caps placed at each end of the solid cylindrical body; and holes disposed proximate to each end of the permeable container, wherein a size of the holes, a number of the holes, or both are selected based, at least in part, on a concentration of hydrogen sulfide in the produced fluids; and hanging the permeable container in a flow of the produced fluids, wherein the holes allow the produced fluid to flow through the permeable container from at one end of the permeable container to at an opposite end of the permeable container.

2. The method of claim 1, wherein placing the well treatment chemical in the permeable container comprises filling the permeable container with an encapsulated corrosion inhibitor.

3. The method of claim 1, comprising selecting a size of the holes disposed proximate to each end of the permeable container based, at least in part, on a target addition rate of the well treatment chemical.

4. The method of claim 1, comprising selecting a location of the holes at each end of the permeable container based, at least in part, on a target addition rate of the well treatment chemical.

5. The method of claim 1, comprising selecting a location of the holes at each end of the permeable container based, at least in part, on a flow rate of the produced fluids.

6. The method of claim 1, comprising selecting a number of the holes disposed proximate to each end of the permeable container based, at least in part, on a target addition rate of the well treatment chemical.

7. The method of claim 1, comprising selecting a size of the holes, a number the holes, or both, based, at least in part, on a concentration of carbon dioxide in the produced fluids.

8. The method of claim 1, comprising suspending the permeable container in the wellbore using a gauge hanger.

9. The method of claim 1, comprising suspending a second permeable container in the wellbore.

10. The method of claim 9, comprising selecting a distance between the permeable container and the second permeable container based, at least in part, on the well treatment chemical used in each container.

11. The method of claim 9, comprising:

placing a first type of chemical in the permeable container; and placing a second type of chemical in the second permeable container.

12. The method of claim 11, comprising:

placing an encapsulated corrosion inhibitor in the permeable container; and placing an unencapsulated corrosion inhibitor in the second permeable container.

13. The method of claim 11, comprising:

placing an encapsulated corrosion inhibitor in the permeable container; and placing a kinetic hydrate inhibitor in the second permeable container.

14. A system for adding chemicals to a produced fluid in a wellbore, comprising:

a gauge hanger; and a permeable container, wherein the permeable container comprises:

a solid cylindrical body;

end caps placed at each end of the solid cylindrical body; and holes disposed proximate to each end of the permeable container, wherein the holes allow the produced fluid to flow through the permeable container from one end of the permeable container to the opposite end of the permeable container;

a well treatment chemical disposed in the permeable container; and a second permeable container suspended from the permeable container by a cable.

15. The system of claim 14, wherein the permeable container comprises the holes in the end caps, and wherein the holes are sized based, at least in part, on a flow rate of the produced fluid.

16. The system of claim 15, wherein the permeable container comprises the holes in the solid cylindrical body proximate to the cap at each end of the solid cylindrical body.

17. The system of claim 14, wherein a mesh screen is disposed over the holes.

18. The system of claim 14, wherein the well treatment chemical comprises particles of an encapsulated corrosion inhibitor disposed in the permeable container.

19. The system of claim 14, wherein the well treatment chemical comprises a kinetic hydrate inhibitor disposed in the permeable container.

20. The system of claim 14, wherein a length of the cable is selected based, at least in part, on the well treatment chemical disposed in the permeable container and a second well treatment chemical disposed in the second permeable container.

21. The system of claim 14, wherein a second well treatment chemical disposed in the second permeable container comprises a corrosion inhibitor.

22. The system of claim 14, wherein a second well treatment chemical disposed in the second permeable container comprises a kinetic hydrate inhibitor.

* * * * *